US010731649B2

(12) United States Patent
Di Sante et al.

(10) Patent No.: US 10,731,649 B2
(45) Date of Patent: Aug. 4, 2020

(54) METHOD FOR COOLING A COMPRESSOR OR VACUUM PUMP AND A COMPRESSOR OR VACUUM PUMP APPLYING SUCH A METHOD

(71) Applicant: ATLAS COPCO AIRPOWER, NAAMLOZE VENNOOTSCHAP, Wilrijk (BE)

(72) Inventors: Alberto Di Sante, Wilrijk (BE); William Maria Jacobs, Wilrijk (BE); Koen Stoop, Wilrijk (BE); Luc Van Mieghem, Wilrijk (BE); Tom Andre J. Potters, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 134 days.

(21) Appl. No.: 15/758,916

(22) PCT Filed: Sep. 19, 2016

(86) PCT No.: PCT/BE2016/000046

§ 371 (c)(1),
(2) Date: Mar. 9, 2018

(87) PCT Pub. No.: WO2017/049368

PCT Pub. Date: Mar. 30, 2017

(65) Prior Publication Data

US 2019/0331116 A1 Oct. 31, 2019

Related U.S. Application Data

(60) Provisional application No. 62/232,671, filed on Sep. 25, 2015.

(30) Foreign Application Priority Data

Jun. 14, 2016 (BE) ..... 2016/5442

(51) Int. Cl.
*F04C 29/06* (2006.01)
*F04C 29/04* (2006.01)
(Continued)

(52) U.S. Cl.
CPC ..... *F04C 29/065* (2013.01); *F01C 21/10* (2013.01); *F04C 18/0207* (2013.01);
(Continued)

(58) Field of Classification Search
CPC ..... F01C 21/10; F04B 39/0027–0072; F04C 18/0207; F04C 18/123; F04C 18/16;
(Continued)

(56) References Cited

U.S. PATENT DOCUMENTS 3,955,905 A * 5/1976 Frommholz ..... F01C 21/104 418/182
4,268,230 A * 5/1981 Bassan ..... F04C 23/00 418/15
(Continued)

FOREIGN PATENT DOCUMENTS

CH 224736 A 12/1942
CN 201461419 U 5/2010
(Continued)

OTHER PUBLICATIONS

International Search Report dated May 4, 2017 on PCT/BE2016/000046.

*Primary Examiner* — Patrick Hamo
*Assistant Examiner* — Joseph S. Herrmann
(74) *Attorney, Agent, or Firm* — Bacon & Thomas, PLLC

(57) ABSTRACT

A compressor or vacuum pump including: —a casing having a cooling gas inlet and a cooling gas outlet for allowing a cooling gas to flow therethrough; —a fan mounted at the cooling gas inlet, including a fan housing and configured to blow said cooling gas into said casing; —a compression or
(Continued)

vacuum chamber including a first housing, a process gas inlet and outlet for allowing a process gas to flow therethrough and at least one rotating element; —a driving module including a second housing and at least one bearing for supporting said at least one rotating element; —a silencer including a cover and configured to attenuate noise generated by the compressor or vacuum pump. The silencer includes a recess structure on its cover, configured to deflect the cooling gas flow from the fan towards the driving module.

15 Claims, 7 Drawing Sheets

(51) Int. Cl.

| | |
|---|---|
| *F01C 21/10* | (2006.01) |
| *F04C 18/02* | (2006.01) |
| *F04C 18/12* | (2006.01) |
| *F04C 18/16* | (2006.01) |
| *F04C 18/344* | (2006.01) |

(52) U.S. Cl.
CPC ..... *F04C 18/123* (2013.01); *F04C 18/16* (2013.01); *F04C 18/344* (2013.01); *F04C 29/045* (2013.01); *F04C 2220/10* (2013.01); *F04C 2240/30* (2013.01)

(58) Field of Classification Search
CPC ..... F04C 18/344; F04C 29/045; F04C 29/06; F04C 29/065; F04C 2220/10; F04C 2240/30
USPC ..... 181/212, 403; 417/312
See application file for complete search history.

(56) References Cited

U.S. PATENT DOCUMENTS

| | | | | | |
|---|---|---|---|---|---|
| 4,420,293 | A * | 12/1983 | Hofmann | F04C 23/00 | 418/101 |
| 4,534,861 | A * | 8/1985 | Wedemeyer | B01D 45/06 | 210/167.02 |
| 5,145,335 | A * | 9/1992 | Abelen | F04B 39/066 | 417/410.3 |
| 5,672,052 | A * | 9/1997 | Ishida | F04C 29/066 | 417/312 |
| 7,232,295 | B2 * | 6/2007 | Kriehn | F04C 18/086 | 417/368 |
| 8,142,172 | B2 * | 3/2012 | Forster | F04C 29/061 | 181/403 |
| 8,821,131 | B2 * | 9/2014 | Yokota | F04B 35/04 | 137/565.18 |
| 10,473,096 | B2 * | 11/2019 | Calhoun | F04B 53/22 | |

FOREIGN PATENT DOCUMENTS

| | | | |
|---|---|---|---|
| CN | 103089647 | A | 5/2013 |
| DE | 3325193 | A1 | 1/1985 |
| DE | 3818381 | A1 | 12/1988 |
| DE | 102007017915 | A1 | 10/2008 |
| DE | 102012012513 | A1 | 12/2012 |
| EP | 1770243 | A2 | 4/2007 |
| JP | 2000073955 | A * | 3/2000 |
| JP | 2000073955 | A | 3/2000 |
| JP | 2009092042 | A | 4/2009 |
| JP | 2014181696 | A | 9/2014 |
| WO | 97/10441 | A1 | 3/1997 |

* cited by examiner

METHOD FOR COOLING A COMPRESSOR OR VACUUM PUMP AND A COMPRESSOR OR VACUUM PUMP APPLYING SUCH A METHOD

BACKGROUND OF THE INVENTION

This invention relates to a compressor or vacuum pump comprising: a casing having a cooling gas inlet and a cooling gas outlet for allowing a cooling gas to flow therethrough; a fan mounted at the cooling gas inlet, comprising a fan housing and configured to blow said cooling gas into said casing; a compression or vacuum chamber comprising a first housing, a process gas inlet and a process gas outlet for allowing a process gas to flow therethrough and at least one rotating element; a driving module comprising a second housing and at least one bearing for supporting said at least one rotating element; a silencer comprising a cover and configured to attenuate noise generated by the compressor or vacuum pump.

Maintaining the temperature of different components of a compressor or vacuum pump under control is a challenge the designers are faced with.

While some of the existing designs are extracting the air from inside the casing of a compressor or vacuum pump and blowing said air into the surrounding environment, other designs use the convection capabilities of different cover materials used to manufacture the components.

An example can be found in US 2009/0 194 177 A1, in the name of Hitachi Koki Co., disclosing a layout for an air compressor using two fans for creating two flows of air and cooling different zones of the compressor unit.

Because the design uses two fans, the casing is provided with three different areas for allowing air to enter within the casing and three other areas for allowing air to flow out of said casing and into the outside environment.

By providing three inlets and three outlets the manufacturing of the casing also gets more complicated, since additional cuts and finishing steps will have to be performed. In some cases such inlets and outlets generate weak structural points for the casing. Because of this, additional reinforcements need to be added, fact that increases the manufacturing time and implicitly the manufacturing costs.

Another drawback of such a design is the complexity of layout, since each of the two fans will have to be connected to a driving unit.

Another example can be found in U.S. Pat. No. 4,283,167 A, in the name of Varian Associates, disclosing a vacuum pump comprising a fan taking air from the outside environment and directing it towards the pump casing. The casing further comprises vertically and horizontally extending fins along its surface, for cooling purposes.

Tests have shown that, during the functioning of a vacuum pump, different temperature areas are being formed between its components, and adjacent positioned components will influence each other's temperature. One of the drawbacks of the above identified vacuum pump is the fact that such areas are not determined or treated differently in terms of cooling. Because of this the cooling process becomes not efficient.

Furthermore, because of the influence of different adjacent positioned components, materials with a high thermal resistance need to be chosen for elements that would not necessarily require it, which increases the manufacturing costs of the unit. On the other hand, if such materials would not be used, the high temperatures involved in the vacuum process would wear them prematurely.

Taking the above mentioned drawbacks into account, it is an object of the present invention to provide a compressor or vacuum pump that would efficiently maintain a desired temperature of its components.

In is another object of the present invention to provide a compressor or vacuum pump with a smaller footprint than the existing units and with a simpler layout.

Further, the present invention aims to increase the lifetime of the components used, and also to reduce the risk of different adjacent components to influence each other's temperature.

Another object of the present invention is to provide an easy to assemble and disassemble compressor or vacuum pump. Because of this, the manufacturing and the maintenance time can be reduced.

SUMMARY OF THE INVENTION

The present invention solves at least one of the above and/or other problems by providing a compressor or vacuum pump comprising:

- a casing having a cooling gas inlet and a cooling gas outlet for allowing a cooling gas to flow therethrough;
- a fan mounted at the cooling gas inlet, comprising a fan housing and configured to blow said cooling gas into said casing;
- a compression or vacuum chamber comprising a first housing, a process gas inlet and a process gas outlet for allowing a process gas to flow therethrough and at least one rotating element;
- a driving module comprising a second housing and at least one bearing for supporting said at least one rotating element;
- a silencer comprising a cover and configured to attenuate noise generated by the compressor or vacuum pump;

whereby said silencer comprises a recess structure on its cover, configured to deflect the cooling gas flow from the fan towards the driving module.

Because the silencer comprises a recess structure on its cover, the cooling gas flow coming from the fan can be deflected towards the driving module, protecting the components of the driving module from reaching high temperatures.

Because the casing comprises only a cooling gas inlet and a cooling gas outlet for allowing a flow of cooling gas therethrough, the compressor or vacuum pump according to the present invention achieves an efficient cooling of the different components by using only the components required to achieve the compression or vacuum process.

The compressor or vacuum pump according to the present invention uses its components, including the casing, for guiding the cooling gas flow wherever cooling is needed. Accordingly, the temperature of all these components is maintained below a desired threshold in an efficient way.

Because the cooling is performed in such a way, the footprint of the compressor or vacuum pump can be reduced considerably, by positioning the components in such a way that the space between adjacent components will be small enough to create channels for concentrating the cooling gas flow wherever high temperatures are known to appear.

Because of this, the order in which different components of the compressor or vacuum pump are being cooled can be also defined through design. Accordingly, for an increased efficiency, the flow of cooling gas can be directed to first reach the components that are known to reach lower temperatures than others, and only before being directed outside the casing, guided towards the components known to reach high temperatures. By considering this, the efficiency of the cooling process is enhanced.

Preferably, the driving module is positioned between the fan and the compression or vacuum chamber.

Tests have shown, that, because of the compression or vacuum process, the process gas within the compression or vacuum chamber, and accordingly the component elements of said compression or vacuum chamber reach a much higher temperature than the ones of the driving module.

If the cooling gas flow coming from the fan would not be directed towards the driving module, the temperature of the compression or vacuum chamber would have a significant influence on the temperature of the component elements within the driving module, resulting in a shorter lifespan for said component elements.

Because of this layout, the cooling process of the compressor or vacuum pump is much more efficient.

The present invention is further directed to a method for cooling a compressor or a vacuum pump, said method comprising the following steps:

- blowing a volume of cooling gas through a cooling gas inlet of a casing of said compressor or vacuum pump;
- deflecting said volume of cooling gas towards a surface of a second housing of a driving module comprising at least one bearing;
- guiding the flow of cooling gas towards a first surface of a first housing of a compression or vacuum chamber comprising at least one rotating element;
- providing a silencer for attenuating noise generated by the compressor or vacuum pump, said silencer comprising a cover;

whereby the step of deflecting the volume of cooling gas entering through said cooling gas inlet towards a surface of the second housing of the driving module further comprises directing said volume of cooling gas through a recess structure on the cover of the silencer.

Because the method according to the present invention follows such steps, the cooling process is much more efficient than for the known compressors or vacuum pumps because the cooling gas flow reaches first the components known to reach a lower temperature during functioning and only afterwards those known to reach a higher temperature.

Accordingly, the different components are being treated differently when it comes to cooling and, because of this, the materials chosen for such components can be the standard ones, even if the compressor or vacuum pump is designed to reach higher compression or lower vacuum limits, which are known to generate higher temperatures.

Because the steps of deflecting and guiding the cooling gas flow are being performed with the help of different components, the footprint of the compressor or vacuum pump is considerably reduced.

The present invention is further directed towards a use of a silencer for cooling a driving module of a compressor or vacuum pump, said silencer comprising a recess on the surface of its cover for deflecting a flow of cooling gas towards said driving module, said driving module comprising at least one bearing.

The present invention is further directed towards a silencer for attenuating the noise generated by a compressor or vacuum pump, said silencer comprising a cover, said silencer comprising a recess structure on said cover having a height H and a length L, wherein said recess structure comprises a relatively straight surface over a distance x and a relatively curved surface over a distance L-x for deflecting a cooling gas away from the silencer and towards a driving module.

BRIEF DESCRIPTION OF THE DRAWINGS

With the intention of better showing the characteristics of the invention, some preferred configurations according to the present invention are described hereinafter by way of an example, without any limiting nature, with reference to the accompanying drawings, wherein.

DETAILED DESCRIPTION OF THE INVENTION

Figure 1:
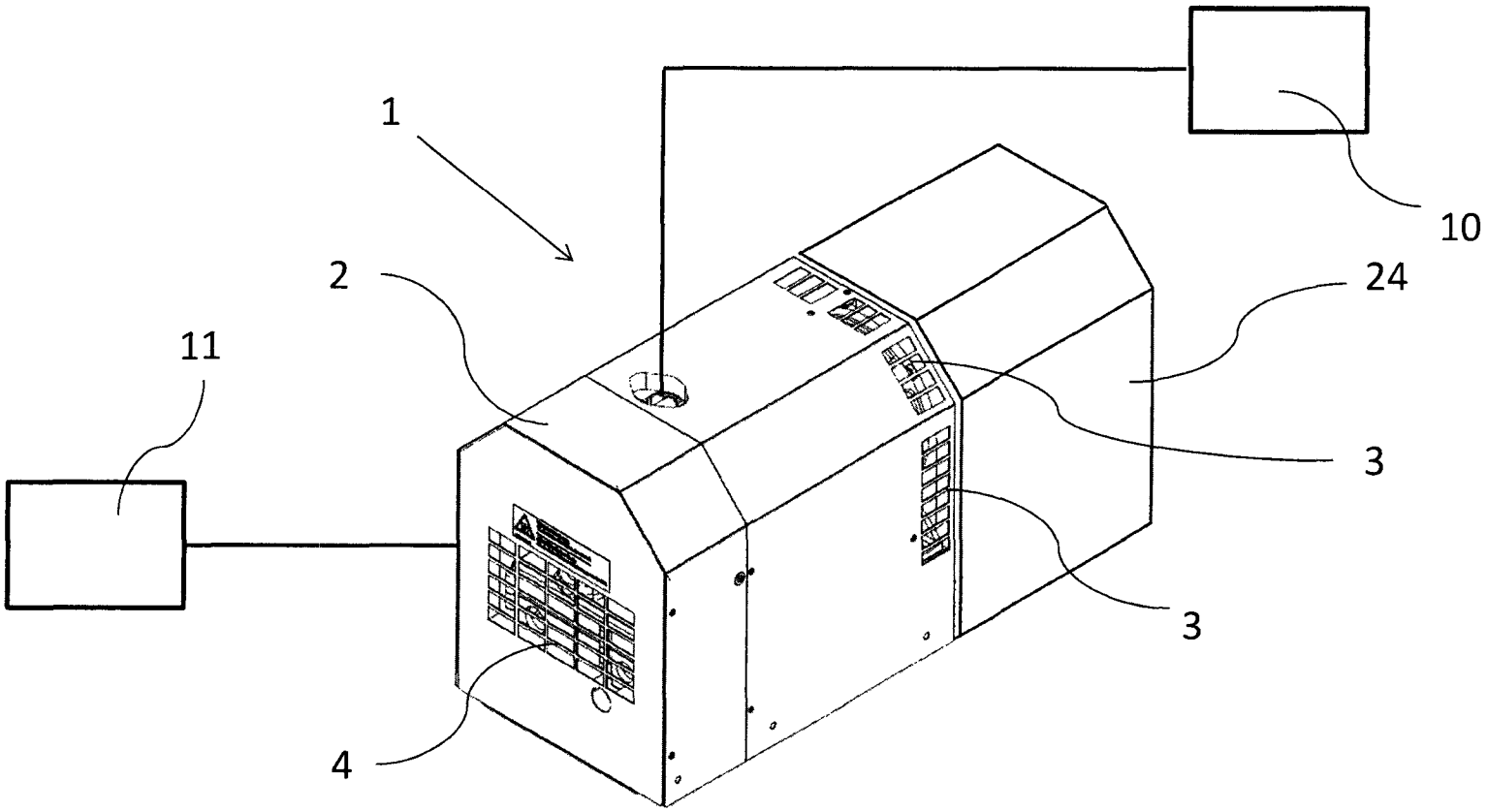
FIG. 1 schematically represents a compressor or vacuum pump according to an embodiment of the present invention.

FIG. 1 shows a compressor or vacuum pump 1 comprising a casing 2, said casing 2 further comprising a cooling gas inlet 3 and a cooling gas outlet 4 for allowing a volume of cooling gas to flow therethrough.

Typically, said cooling gas is air, but it is to be understood that the present invention is not limited to air as cooling gas, and that it can work with other types of gases as well.

Figure 2:
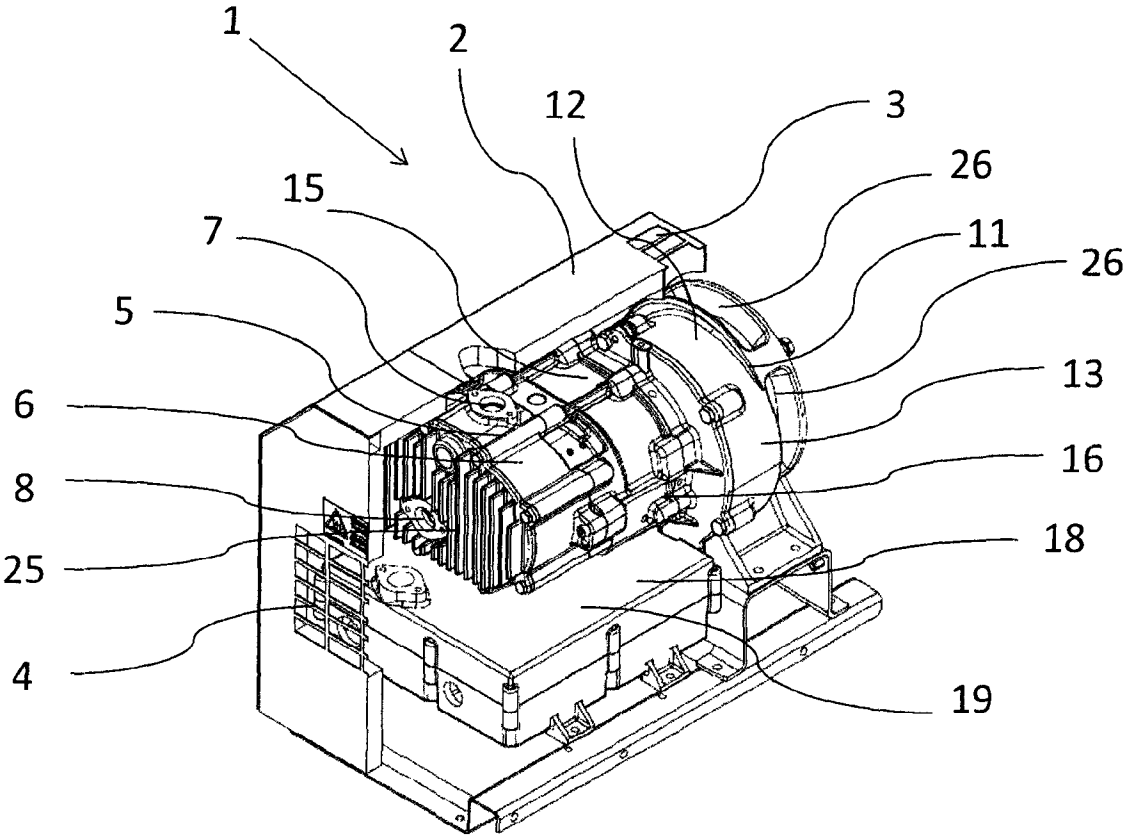
FIG. 2 schematically represents an internal layout of a compressor or vacuum pump according to an embodiment of the present invention.
Figure 4:
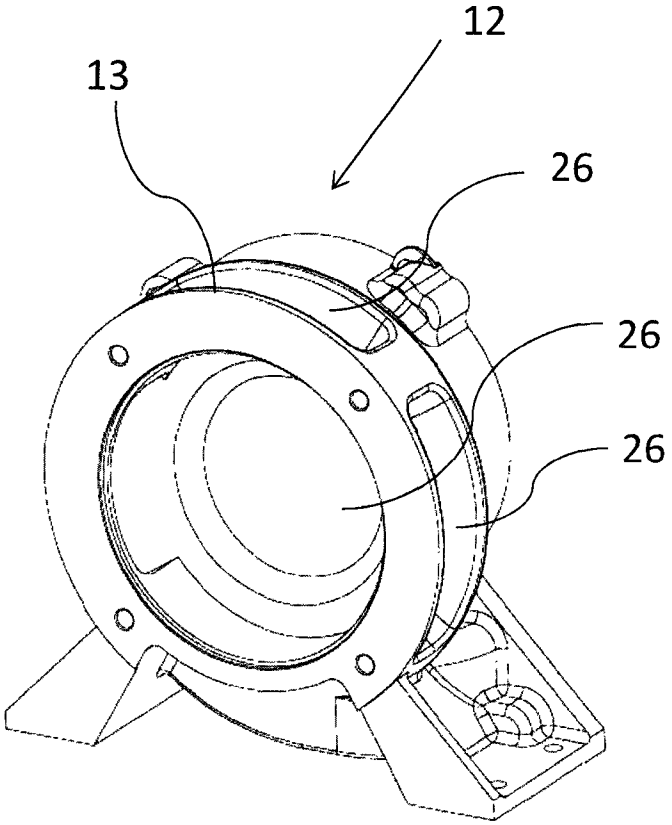
FIG. 4 schematically represents a view of the fan represented in FIG. 3, rotated 180° by axis AA'.
Figure 6:
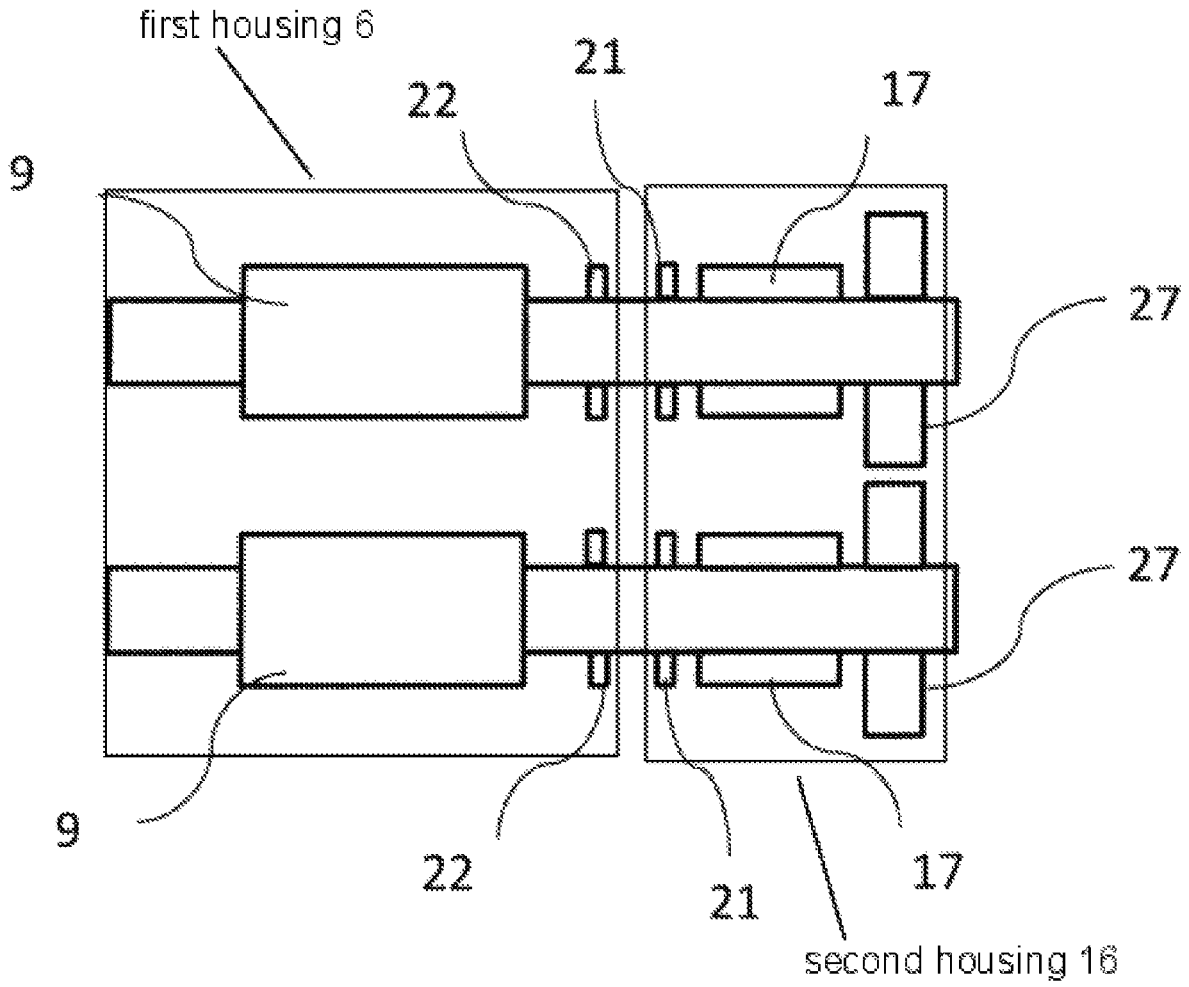
FIG. 6 schematically represents the internal components of the vacuum chamber and driving module according to an embodiment of the present invention.

As shown in FIG. 2, the compressor or vacuum pump 1 further comprises a compression or vacuum chamber 5 delimited by a first housing 6, a process gas inlet 7 and a process gas outlet 8 for allowing a process gas to flow therethrough and at least one rotating element 9 (FIG. 6).

The process gas inlet 7 can be connected to an external module 10 (FIG. 1), which can be either a source of a gas in the case of a compressor or a receiver of a gas in the case of a vacuum pump. The process gas outlet 8 can be further connected to a user's network 11, wherein the compressed gas is provided or wherein vacuum is created.

In the context of the present invention a compressor or vacuum pump 1 should be understood to include a single screw compressor, a multiple screw compressor, a scroll compressor, a single claw vacuum pump, a multiple claw vacuum pump, a single screw vacuum pump, a multiple screw vacuum pump, a scroll vacuum pump, a rotary vane vacuum pump, etc. Each of the above identified types of compressors or vacuum pumps can be oil injected or oil free.

It is further to be understood that said at least one rotating element 9 represents the at least one screw, scroll or claw element of the above identified compressors or vacuum pumps 1, which by rotating generates vacuum or compressed gas.

The compressor or vacuum pump 1 of the present invention further comprises a fan 12 mounted at the cooling gas inlet 3, comprising an impeller (not shown) and a fan housing 13 and configured to blow cooling gas inside said casing 2.

Figure 3:
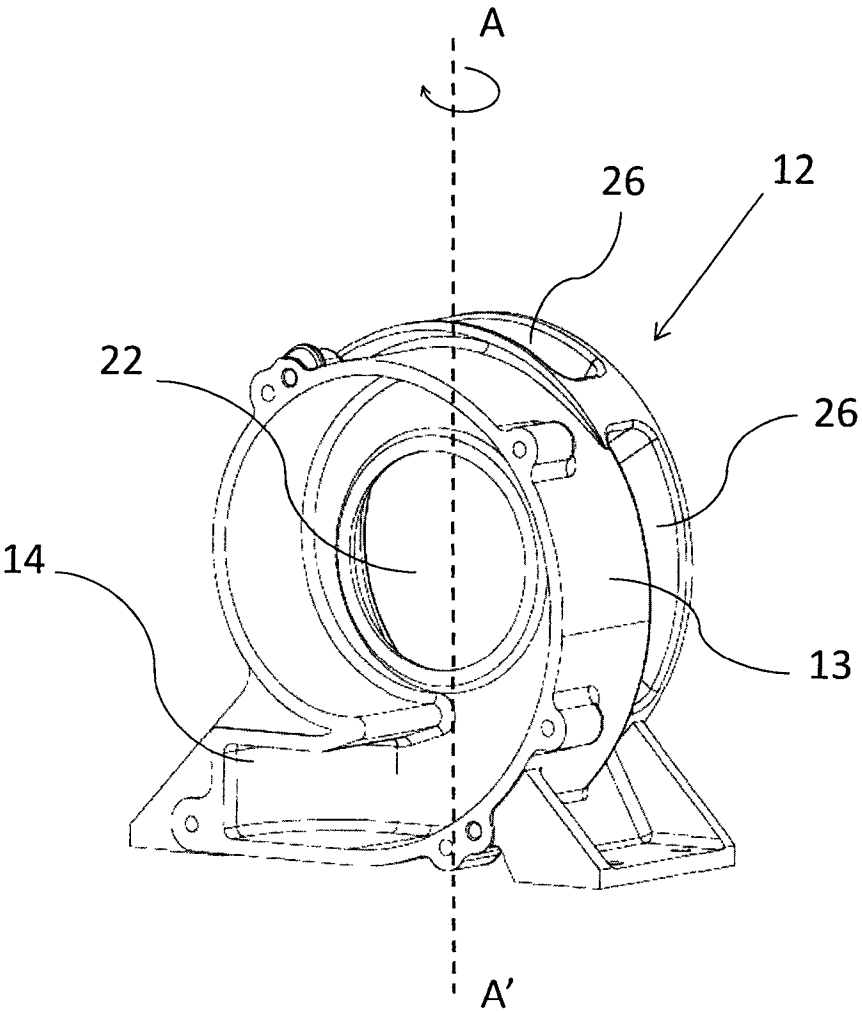
FIG. 3 schematically represents a layout of a fan according to an embodiment of the present invention.

Preferably, but not limiting to, the fan housing 13 is in the shape of a volute on the side facing the casing 2 (FIG. 3), said volute comprising a channel 14 for directing the cooling gas driven by the impeller towards the inside of the casing 2.

On the opposite side of the volute, the fan housing 13 comprises at least one orifice for allowing cooling gas to enter inside and be displaced by the movement of the impeller towards the inside of said casing 2.

Preferably, the fan housing 13 further comprises orifices on the lateral sides, for allowing a bigger volume of cooling gas to reach the impeller.

The compressor or vacuum pump 1 further comprises a driving module 15 (FIG. 2 and FIG. 7) comprising a second housing 16 and at least one bearing 17 (FIG. 6) for supporting said at least one rotating element 9.

Figure 5:
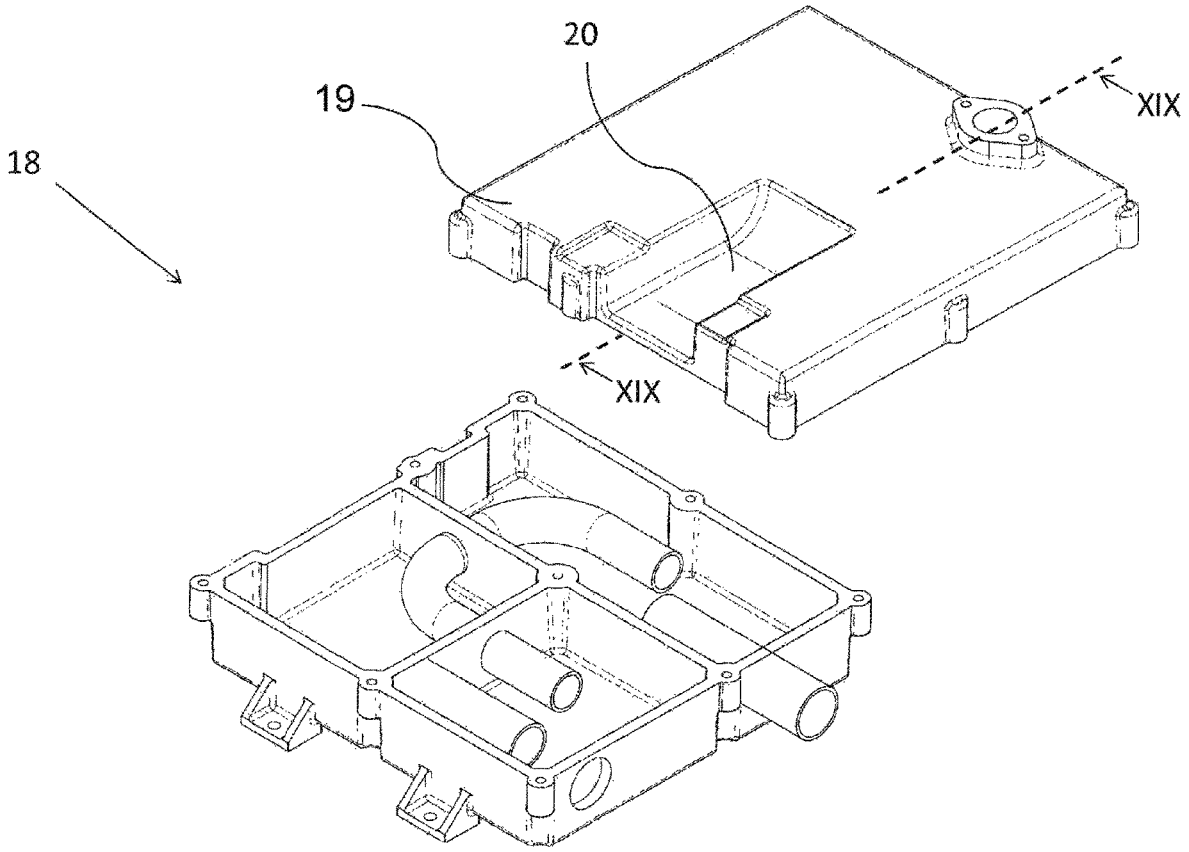
FIG. 5 schematically represents an exploded view of a layout of a silencer according to an embodiment of the present invention.

Further, the compressor or vacuum pump 1 according to the present invention comprises a silencer 18 comprising a cover 19 and configured to attenuate noise generated by the compressor or vacuum pump 1 (FIG. 5).

Preferably, the silencer 18 comprises a recess structure 20 on its cover 19, configured to deflect the cooling gas flow from the fan 12 towards the driving module 15.

Figure 9:
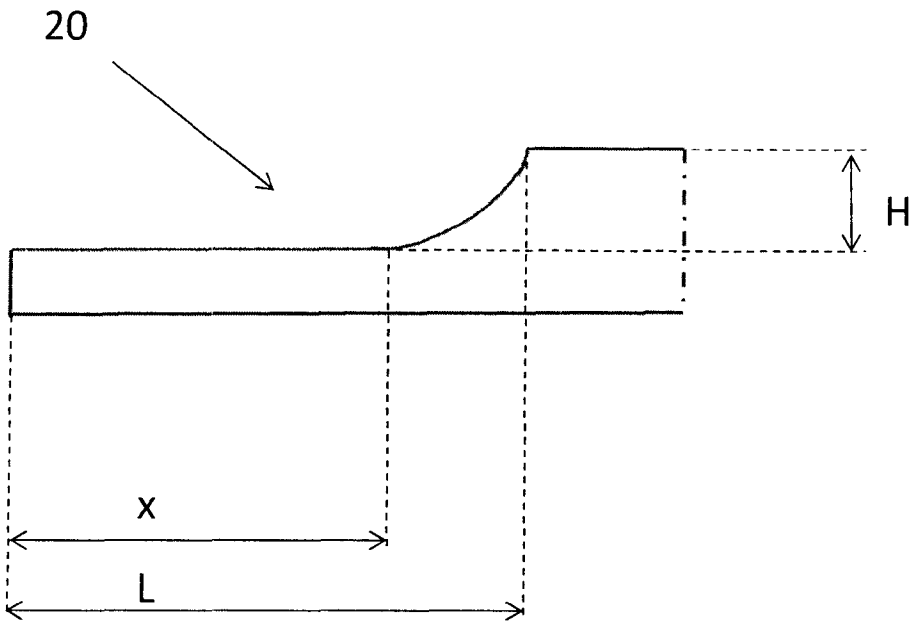
FIG. 9 schematically represents the recess structure over a part of the cut according to line XIX-XIX in FIG. 5.

In a preferred embodiment according to the present invention, and as illustrated in FIG. 9, the recess structure 20 has a height H and a length L and is preferably designed to allow the flow of cooling gas coming from the fan 12 to maintain its trajectory over a distance x, inside said recess structure 20. Over the distance L-x the recess structure 20 preferably comprises a slope or a curved surface for deflecting the flow of cooling gas away from the silencer 18 and towards the driving module 15.

In one embodiment according to the present invention, the recess structure 20 can comprise a slope over the whole distance L, in which case x would be zero.

In another embodiment according to the present invention, said recess structure 20 can comprise two or more channels having a height H and a length L, like mentioned above.

In yet another embodiment according to the present invention, the recess structure 20 can be in the shape of a triangle with rounded edges, having the base of said triangle on the side facing the channel 14 of the fan 12 and the tip of the triangle in the vicinity of the driving module 15. Said triangle can create a continuous slope over the distance L, in which case x would be zero, or said slope can begin after a distance x (wherein x has a different value than zero) from the edge of the cover 19 of the silencer 18.

With the help of said recess structure 20 the compressor or vacuum pump 1 is making use of its components in order to control the direction of the flow of cooling gas coming from the fan 12 and also allows a control of the surface of the components such flow of cooling gas enters in contact with. Because of this, a more controlled cooling process can be designed with more efficient and predictable results.

Preferably, said driving module 15 further comprises and oil bath within said second housing 16 for cooling and/or lubricating said at least one bearing 17, said oil bath not being represented in the drawings.

For sealing purposes, a seal 21 is provided within the second housing 16 (FIG. 6), said seal 21 preferably being positioned on the side facing the compression or vacuum chamber 5 for preventing oil from leaving the driving module 15.

Typically the second housing 16 can be manufactured from metal, such as, for example and not limiting to: iron, stainless steel, Aluminum, Aluminum alloy or any other metal or alloys thereof.

In the context of the present invention it is to be understood that the at least one rotating element 9 comprises a rotor body enclosed within the compression or vacuum chamber 5 and a rotor shaft enclosed within the driving module 15 and around which the bearing 17 and the seal 21 are provided. Preferably, the at least one rotating element 9 further comprises a gas seal 22 before exiting the first housing 6 of the compression or vacuum chamber 5. Because of this, the first and the second housing 6 and 16 are sealed from each other, with the exception of the rotor shaft of the at least one rotating element 9 entering the second housing 16 of the driving module 15.

Typically, for efficiency purposes, both the seal 21 and the gas seal 22 can manufactured from materials such as different types of polymers or rubbers (synthetic or natural) and such materials are known to have a relatively low melting point when compared with the other component elements such as the at least one bearing 17 or the second housing 16.

Because of this, the temperature of the driving module 15 needs to be maintained below a certain threshold determined based on the material used for the seal 21. Moreover, the temperature of the oil within the oil bath needs to be also maintained below a certain threshold in order not to modify the properties of the oil.

By deflecting the cooling gas flow coming from the fan 12 towards the driving module 15 with the help of the recess structure 20, the temperature of the components is maintained below the thresholds, prolonging the life span of the seal 21 and of the oil within the oil bath. Because of this, the periodical maintenance of the compressor or vacuum pump 1 can be performed after a longer time period, making the compressor or vacuum pump 1 according to the present invention less costly and more reliable.

In the context of the present invention it is to be understood that, if the compressor or vacuum pump 1 is a double screw or double tooth or double claw compressor or vacuum pump 1, the driving module 15 will comprise two bearings 17, each used for supporting one rotating element 9 and each having at least one seal 21 and each being provided around one rotor shaft.

Figure 8:
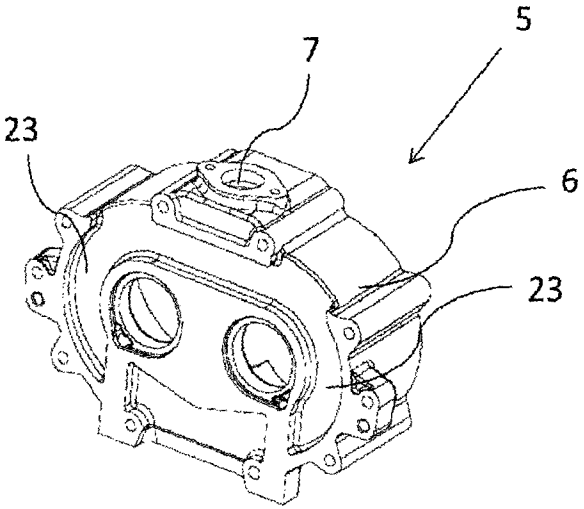
FIG. 8 schematically represents a compression or vacuum chamber according to an embodiment of the present invention.
Figure 7:
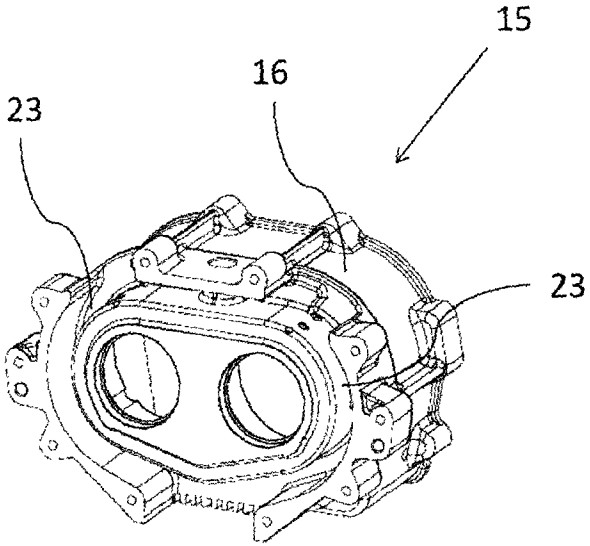
FIG. 7 schematically represents a driving module according to an embodiment of the present invention.

In a preferred embodiment according to the present invention, the compressor or vacuum pump 1 further comprises a channel structure 23 between the first housing 6 of the compression or vacuum chamber 5 and the second housing 16 of the driving module 15, for allowing cooling gas to flow between the first and the second housing 6 and 16 (FIG. 7 and FIG. 8).

Preferably, the channel structure 23 is created in such a way that the cooling gas flow is prevented from entering the first housing 6 of the compression or vacuum chamber 5, or the second housing 16 of the driving module 15.

Because of this, a cooling gas layer is maintained between the first and the second housing 6 and 16 during the functioning of the compressor or vacuum pump 1.

As an example, and as illustrated in FIG. 7, said channel structure 23 can be in the shape of a groove created in the vicinity of the exterior wall of the second housing 16 of the driving module 15, on the side facing the first housing 6, in the vicinity of both lateral walls. Accordingly, when the second housing 16 of the driving module 15 and the first housing 6 of the compression or vacuum chamber 5 are mounted within the compressor or vacuum pump 1, a channel structure 23 is being created between said first and second housing 6 and 16, such that cooling gas can travel between said first and second housing 6 and 16 after being deflected by the recess structure 20 and further reach the casing 2 on the side opposite from where the silencer 18 is mounted.

In another embodiment according to the present invention, if the compressor or vacuum pump 1 comprises two bearings 17, the channel structure 23 can also be created between the two bearings 17, or the channel structure 23 can comprise the groove created close to the lateral walls and on the side facing the first housing 6 and the channel structure 23 created between the two bearings 17.

Said cooling channel structure 23 can have a simple structure such as approximately parallel with the exterior wall of the second housing 16, and/or approximately straight when it comes to the channel in between the two bearings 17, or it can have a more complex irregular or tortuous shape.

In another embodiment according to the present invention, the channel structure 23 and/or the groove type of structure can further comprise fins. Said fins increasing the efficiency of the cooling process since they are acting as a radiator.

In yet another embodiment according to the present invention, the first and the second housing 6 and 16 can be created as a single housing and the cooling channel structure 23 can be created through casting.

Tests have shown that the temperature of the process gas in the compression or vacuum chamber 5 reaches a much higher temperature than the bearings 17 and the oil within the driving module 15. Because of this, the created cooling gas layer becomes very important, since it reduces the risk of a temperature influence between said first and second housing 6 and 16 through conduction. At the same time, the cooling gas flow achieves efficient cooling for both the first housing 6 of the compression or vacuum chamber 5 and the second housing 16 of the driving module 15.

In a preferred embodiment according to the present invention, the driving module 15 is positioned between the fan 12 and the compression or vacuum chamber 5.

By adopting such a layout, the maintenance of the compressor or vacuum pump 1 can be performed in a very easy way.

If we take the example of a vacuum pump 1, it is known that a periodical cleaning of the at least one rotating element 9 needs to be performed. By positioning the driving module 15 between the fan 12 and the vacuum chamber 5, a user of a vacuum pump according to the present invention would only need to open the casing 2 of the vacuum pump 1 and the first housing 6 of the vacuum chamber 5, remove the at least one rotating element 9, clean it and continue using the vacuum pump in his application.

Because of this, the maintenance can be performed by the user, resulting in much lower maintenance costs and much shorted time intervals in which the vacuum pump is not used.

For ease of manufacturing and compactness, the fan 12 and the at least one bearing 17 are preferably mounted on a common shaft.

It should be understood that the present invention is not limited to the above described layout and that the fan 12 and the at least one bearing 17 can also be mounted on different shafts.

Preferably, the compressor or vacuum pump 1 also comprises a motor 24 positioned outside of the casing 2 and driving the at least one rotating element 9.

The compressor or vacuum pump 1 can further comprise a thermal shield (not shown), provided between said motor 24 and the fan 12. The thermal shield can be selected from a group comprising: a metal plate, a radiator, an insulating material, a fan mounted within the casing of the motor and directing a flow of cooling gas away from the compressor or vacuum pump 1, or said motor 24 can be placed at a minimum distance from the compressor or vacuum pump 1 such that possible thermal influences between the two are eliminated.

In another embodiment according to the present invention, the fan 12 is positioned within the casing 2 and can further comprise an area of a perforated material, for allowing the fan 12 to retrieve cooling gas from outside the casing 2 without having a temperature influence induced by said motor 24. Such area can be created on at least one side of the casing 2, or on two sides of the casing 2, preferably said area can be created on three sides of the casing, even more preferably, said area can be created on the casing 2 along the circumference of the fan 12.

In yet another embodiment the fan 12 can comprise at least an orifice 26 for allowing a volume of cooling gas to reach the impeller. Preferably, but not limiting to, for an increased cooling efficiency, the fan 12 comprises a plurality of orifices 26 throughout its circumference and/or through its center.

Preferably, said motor 24 drives the shaft that rotates the fan 12 and also rotates the at least one rotating element 9, by connecting said shaft with at least one bearing 17 within the second housing 16 of the driving module 15.

If the compressor or vacuum pump 1 has two rotating elements 9, a bull gear 27 (FIG. 6) can be used for synchronizing the movement of the rotating element 9 driven by the motor with the movement of the other rotating element 9.

In another embodiment according to the present invention, the motor 24 can drive the shaft on which the fan 12 is mounted individually from the shaft driving the at least one rotating element 9.

In yet another embodiment according to the present invention, the fan 12 can be driven by a different motor (not shown) than the at least one rotating element 9.

The fan 12 can be mounted such that the volute of the fan housing 13 is in direct contact and overlaps with the second housing 16 of the driving module 15, or the fan 12 can be positioned perpendicularly on the second housing 16 of the driving module 15.

For an even more efficient cooling, the compressor or vacuum pump 1 can further comprise a radiator 25 positioned on the first housing 6 of the compression or vacuum chamber 5.

Because the compressor or vacuum pump 1 has such a layout, an efficient cooling of all the components is performed and the risks of deformations that can occur due to areas reaching high temperatures are minimized or even eliminated.

In a preferred embodiment according to the present invention, the silencer 18 is positioned under the compression or vacuum chamber 5.

Because of this, the compressor or vacuum pump 1 according to the present invention is very compact when compared with the existing ones.

Preferably, the silencer 18 is positioned under the compression or vacuum chamber 5, such that the first housing 6 of the compression or vacuum chamber 5 starts after the length L of the recess structure 20. Even more preferably, the silencer 18 is positioned such that the cooling gas flowing through the recess structure 20 is directed between the first housing 6 of the compression or vacuum chamber 5 and the second housing 16 of the driving module 15.

The first housing 6 of the compression or vacuum chamber 5 can be directly placed on the cover 19 of the silencer 18.

Because of this the cooling gas flow coming from the fan 12, is directed within the recess structure 20 along the length L, and further through the channel structure between the first and the second housing 6 and 16. Accordingly the cooling gas coming from the fan 12 is not allowed to dissipate within the entire casing 2 and its path is controlled through the layout of the compressor or vacuum pump 1.

After the cooling gas flow passes through the channel structure between the first and the second housing 6 and 16, it reaches the casing 2, which preferably further comprises means to deflect the cooling gas flow along a first surface of the first housing 6 of the compression or vacuum chamber 5, means to further redirect said cooling gas flow along a second surface of the first housing 6 of the compression or vacuum chamber 5, in the direction of the silencer 18, and further comprises means to direct the cooling gas flow outside the casing 2.

Preferably, said means to deflect, redirect and direct said cooling gas flow can be in the shape of specific bends of the casing 2, or additional components attached to said casing 2, or different components of the compressor or vacuum pump 1 positioned such that the cooling gas flow changes direction.

Accordingly, the cooling gas flow will pass along three faces of the compression or vacuum chamber 5 before being directed to the outside environment. Because of this, the compression or vacuum chamber 5, where the highest temperatures occur, is efficiently cooled through the entire functioning of the compressor or vacuum pump 1.

Preferably, but not limiting to, said compressor or vacuum pump 1 is a claw compressor or vacuum pump.

The present invention is further directed to a method for cooling a compressor or a vacuum pump 1, wherein a volume of cooling gas from the outside environment is blown through a cooling gas inlet 3 of a casing 2 of a compressor or vacuum pump 1. Said volume of cooling gas is deflected towards a surface of a second housing 16 of a driving module 15, for cooling said casing. Said driving module 15 comprises at least one bearing 17.

The flow of cooling gas is then guided towards a first surface of a first housing 6 of a compression or vacuum chamber 5 comprising at least one rotating element 9, which is also cooled.

The method according to the present invention further comprises the step of providing a silencer 18 for attenuating noise and possibly also vibrations generated by the compressor or vacuum pump 1, said silencer 18 comprising a cover 19.

Preferably, the volume of cooling gas is deflected towards the surface of the second housing 16 of the driving module 15 by directing said volume of cooling gas through a recess structure 20 on the cover 19 of the silencer 18.

For a complete cooling of the compressor or vacuum pump 1, the method further comprises the step of guiding the flow of cooling gas from said first surface along a second surface of the first housing 6 of the compression or vacuum chamber 5 and further through a cooling gas outlet 4 of the casing 2.

Preferably, the method according to the present invention further comprises the step of guiding the deflected flow of cooling gas along the height of the driving module 15 by providing a channel between the first housing 6 of the compression or vacuum chamber 5 and the second housing 16 of the driving module 15.

The present invention is further directed towards a use of a silencer 18 for cooling a driving module 15 of a compressor or vacuum pump 1, said silencer 18 comprising a recess structure 20 on the surface of its cover 19 for deflecting a flow of cooling gas towards said driving module 15, whereby said driving module 15 comprises at least one bearing 17.

The present invention is further directed towards a silencer for attenuating the noise generated by a compressor or vacuum pump, said silencer 18 comprising a cover 19, characterized in that said silencer 18 comprises a recess structure 20 on said cover 19 having a height H and a length L, wherein said recess structure 20 comprises a relatively straight surface over a distance x and a relatively curved surface over a distance L-x for deflecting a cooling gas away from the silencer 18 and towards a driving module 15.

The present invention is by no means limited to the embodiments described as an example and shown in the drawings, but such a compressor or vacuum pump 1 and/or silencer 18 can be realized in all kinds of variants, without departing from the scope of the invention.

The invention claimed is:

1. A compressor or vacuum pump comprising:

a casing having a cooling gas inlet and a cooling gas outlet for allowing a cooling gas to flow therethrough;

a fan mounted at the cooling gas inlet, comprising a fan housing and an impeller configured to blow said cooling gas into said casing;

a first housing having a process gas inlet and a process gas outlet for allowing a process gas to flow therethrough, the first housing delimiting a compression chamber or a vacuum chamber and having at least one rotating element located therein;

a driving module comprising a second housing and at least one bearing for supporting said at least one rotating element;

a silencer comprising a cover and being configured to attenuate noise generated by the compressor or vacuum pump;

wherein said silencer comprises a recess structure on the cover, configured to deflect the cooling gas flow from the fan towards the driving module.

2. The compressor or vacuum pump according to claim 1, wherein at least one bearing is lubricated with oil.

3. The compressor or vacuum pump according to claim 2, wherein each of said at least one bearing has a respective seal for preventing the oil from leaving the driving module.

4. The compressor or vacuum pump according to claim 1, wherein the cooling gas is able to flow between said first housing and said second housing.

5. The compressor or vacuum pump according to claim 1, wherein the driving module is positioned between the fan housing and the first housing.

6. The compressor or vacuum pump according to claim 5, wherein the impeller and one of the at least one bearing are mounted on a common shaft.

7. The compressor or vacuum pump according to claim 6, further comprising a motor positioned outside of the casing and driving the at least one rotating element with the common shaft.

8. The compressor or vacuum pump according to claim 1, further comprising a radiator positioned on the first housing.

9. The compressor or vacuum pump according to claim 1, wherein the silencer is positioned under the compression or vacuum chamber.

10. The compressor or vacuum pump according to claim 1, wherein the casing is configured to deflect the cooling gas flow along a first surface of the first housing, to redirect said cooling gas flow along a second surface of the first housing towards the silencer, and to direct the cooling gas flow outside the casing.

11. The compressor or vacuum pump according to claim 1, wherein said compressor or vacuum pump is a claw compressor or vacuum pump.

12. The compressor or vacuum pump according to claim 1, wherein said recess structure has a height H and a length L, wherein said recess structure comprises a straight surface over a distance x and a curved surface over a distance L-x.

13. A method for cooling a compressor or a vacuum pump, said method comprising the following steps:

flowing a volume of cooling gas through a cooling gas inlet of a casing of said compressor or vacuum pump with a fan;

a first housing delimiting a compression chamber or a vacuum chamber and having at least one rotating element located therein;

a driving module comprising a second housing and at least one bearing;

deflecting said volume of cooling gas towards a surface of the second housing of the driving module;

guiding the flow of cooling gas towards a first surface of the first housing;

providing a silencer for attenuating noise generated by the compressor or vacuum pump, said silencer comprising a cover;

wherein the step of deflecting the volume of cooling gas entering through said cooling gas inlet towards a surface of the second housing of the driving module further comprises directing said volume of cooling gas through a recess structure on the cover of the silencer.

14. The method for cooling the compressor or vacuum pump according to claim 13, further comprising the step of guiding the flow of cooling gas from said first surface along a second surface of the first housing and through a cooling gas outlet of the casing.

15. The method for cooling a compressor or a vacuum pump according to claim 13, further comprising the step of guiding the deflected flow of cooling gas along the height of the driving module.

* * * * *